United States Patent [19]

Rosamilia et al.

[11] Patent Number: 4,590,102

[45] Date of Patent: May 20, 1986

[54] LOW TEMPERATURE CURING OF NONWOVEN PRODUCTS BONDED WITH N-METHYLOLACRYLAMIDE-CONTAINING COPOLYMERS

[75] Inventors: Peter L. Rosamilia, Waretown, N.J.; George Davidowich, Allentown, Pa.

[73] Assignee: Air Products and Chemicals, Inc., Allentown, Pa.

[21] Appl. No.: 689,201

[22] Filed: Jan. 7, 1985

[51] Int. Cl.[4] ..... D02G 3/00; B05D 3/02

[52] U.S. Cl. ..... 427/374.1; 427/389; 427/391; 427/392; 427/393

[58] Field of Search ..... 427/389.9, 391, 392, 427/393, 389, 374.1

[56] References Cited

U.S. PATENT DOCUMENTS

| | | | |
|---|---|---|---|
| 3,380,851 | 4/1968 | Lindemann et al. | 117/140 |
| 3,787,232 | 1/1974 | Mikotalvy et al. | 117/155 |
| 4,051,278 | 9/1977 | Democh | 427/326 |
| 4,145,248 | 3/1979 | Van Eanam et al. | 162/168 R |
| 4,158,070 | 6/1979 | Lewicki, Jr. et al. | 427/8 |
| 4,256,809 | 3/1981 | Larsson et al. | 427/389 X |
| 4,279,959 | 7/1981 | Falgiatore et al. | 427/389 X |
| 4,297,400 | 10/1981 | Kern et al. | 427/389 |
| 4,312,914 | 1/1982 | Guth | 427/389 X |
| 4,449,978 | 5/1984 | Iacoviello | 604/372 |
| 4,505,951 | 3/1985 | Kennedy | 427/55 |

OTHER PUBLICATIONS

Airflex TM 120 Nonwoven Binder Brochure.
Airflex 105 Nonwoven Binder Brochure.
Airflex 120 Emulsion Brochure.
Airflex 105 Emulsion Brochure.

*Primary Examiner*—Thurman K. Page
*Attorney, Agent, or Firm*—Michael Leach; James C. Simmons; E. Eugene Innis

[57] ABSTRACT

A nonwoven substrate impregnated with a vinyl acetate/ethylene/N-methylolacrylamide or vinyl chloride/ethylene/N-methylolacrylamide copolymer emulsion binder is cured by employing an acidic substance having a pKa of 1 to 2, sufficiently drying to volatilize a substantial amount of the water while not substantially cross-linking the copolymer binder and maintaining the dried nonwoven substrate at a temperature less than that for drying for a time sufficient to develop essentially full cure.

20 Claims, No Drawings

LOW TEMPERATURE CURING OF NONWOVEN PRODUCTS BONDED WITH N-METHYLOLACRYLAMIDE-CONTAINING COPOLYMERS

TECHNICAL FIELD

The invention relates to the acid catalyzed curing of N-methylol-acrylamide-containing resin binders deposited from an aqueous emulsion on a nonwoven web of fibers.

BACKGROUND OF THE INVENTION

The nonwovens industry is continually seeking ways to conserve energy in its overall operations. One area which is being examined is the use of aqueous crosslinking resin binder emulsions which require thermal curing. Here the desire is to eliminate or minimize the temperature, or energy. required to cure the resin binders after volatilizing the water while maintaining the properties of the nonwoven product, for instance, wet tensile strength, solvent tensile, brightness, absorbency and like properties.

The use of N-methylolacrylamide-containing copolymer binders in the preparation of nonwoven products is well known in the art. See for example U.S. Pat. Nos. 3,380,851; 3,787,232 and 4,449,978. It is also well known in the art to mix a suitable acid curing agent for the N-methylolacrylamide in order to cure the binder by heating to form a cross-linked interpolymer. Known acidic curing agents include mineral acids, e.g. hydrogen chloride, or organic acids, e.g. oxalic acid, or acid salts such as ammonium chloride.

The nonwoven web of fibers is impregnated with the binder emulsion containing an acidic curing agent and then dried and cured. The nonwoven products are suitably dried by passing them through an air oven or the like and then through a curing oven. Typical laboratory conditions to achieve optimal cross-linking are sufficient time and temperature such as drying at 150° to 200° F. (66°-93° C.) for 4 to 6 minutes, following by curing at 300° to 310° F. (149° to 154° C.) for 3 to 5 minutes or more. However, other time-temperature relationships are employed in industry as is well known in the art, shorter times at higher temperatures or longer times at lower temperatures depending on product grade.

SUMMARY OF THE INVENTION

Generally, in the art the N-methylolacrylamide-containing binder resin emulsion also containing an acid curing agent is applied to a nonwoven web of fibers, the nonwoven substrate. This "wet", or impregnated, substrate is then heated to an elevated temperature for a period of time to drive off water and to effect cross-linking of the N-methylolacrylamide moiety in the resin, i.e. curing. The present invention provides a method for preparing a nonwoven product bonded with an N-methylolacrylamide-containing vinyl acetate/ethylene or vinyl chloride/ethylene copolymer resin by a low temperature curing process.

The improvement of the present invention comprises applying to a nonwoven substrate a mixture of the resin binder emulsion and a low temperature curing agent having a $pk_a$ ranging from about 1 to 2, heating, or drying, the impregnated nonwoven substrate for a time and at a temperature sufficient to volatilize a substantial amount of the water but insufficient to effect substantial cross-linking of the N-methylolacrylamide containing polymer, and allowing the copolymer on the dried nonwoven substrate to cure at a temperature of less than that for drying, for a time sufficient to develop essentially full cure.

The invention can also be viewed in another embodiment as an improvement in a process for acid catalyzed curing of a nonwoven substrate impregnated with a vinyl acetate/ethylene/N-methylolacrylamide or a vinyl chloride/ethylene/N-methylolacrylamide copolymer; the improvement provides for maintaining the curing temperature while shortening the curing time or maintaining curing time at a lower curing temperature by using an acidic substance having a $pk_a$ ranging from about 1 to 2.

The practice of the present method provides energy savings with less heat degradation the substrate or a production increase at the same energy consumption with minimum machine modifications.

Further advantages of the invention include improved broke recovery and the ability to utilize heat-sensitive nonwoven substrates.

The degree of cure required will vary with the nonwoven producer. Some producers want a more efficient full wet cure at the end of the production machine while others want a partial cure with a full cure developing within 30 days. Many require this full cure development within 7 days. This delayed curing would allow the nonwovens producers to recover and reuse their substrate broke. Since the substrate is not fully cured. it can be easily recovered by repulping operations. Currently, there is significant waste due to poor recovery of the fully cured substrate. In addition, since the polymer is not cured, it is easier to maintain equipment cleanliness contributing to improved machine runability and less down-time.

DETAILED DESCRIPTION OF THE INVENTION

The binder emulsions for preparing nonwoven products utilizing the low temperature curing method of the invention are suitably vinyl acetate/ethylene/N-methylolacrylamide or vinyl chloride/ethylene/N-methylolacrylamide copolymer systems. Typically, the N-methylolacrylamide is present in such copolymers in amounts ranging from about 1 to 15 wt %. Especially preferred are copolymers of vinyl acetate/ethylene/N-methylolacrylamide in which the copolymer contains 5 to 40 wt % ethylene and N-methylolacrylamide being about 0.5 to 10 wt % of the vinyl acetate. Many such N-methylolacrylamide-containing copolymer binder emulsions are commercially available or they can be prepared by processes well known in the art in which the N-methylolacrylamide monomer is added to the polymerization recipe up-front or preferably, is metered into the reaction vessel over a period of time.

Illustrative of procedures that can be used to prepare such N-methylolacrylamide-containing copolymer emulsions is the description of the following process for preparing a vinyl acetate/ethylene/N-methylolacrylamide copolymer emulsion.

Vinyl acetate and ethylene are copolymerized in the presence of a protective colloid or surfactants in an aqueous medium under pressure not exceeding about 100 atm. and in the presence of a free radical initiator which is added incrementally, the aqueous system being maintained by suitable buffering agents at a pH of about 2 to 6. The process first involves a homogenization in which the vinyl acetate suspended in water is thoroughly agitated in the presence of ethylene under the working pressure to effect solution of the ethylene in the vinyl acetate while the reaction medium is gradually heated to polymerization temperature. The homogenization period is followed by a polymerization period during which the free radical source, which may consist of a redox system comprising an oxidizing agent and a reducing agent, is added incrementally.

Free radical sources such as redox systems, emulsifying agents such as protective colloids and surfactants, and buffering agents as are well known in the art may be used.

Various free-radical forming catalysts can be used in carrying out the polymerization of the monomers, such as peroxide compounds. Combination-type catalysts employing both reducing agents and oxidizing agents can also be used, i.e. a redox system. Suitable reducing agents include bisulfites, sulfoxylates, or other compounds having reducing properties such as ferrous salts and tertiary aromatic amines, e.g. N,N-dimethyl aniline. The oxidizing agents include hydrogen peroxide, organic peroxides such as benzoyl peroxide, t-butyl hydroperoxide and the like, persulfates, such as ammonium or potassium persulfate, perborates and the like. Specific combination-type catalysts or redox systems which can be used include hydrogen peroxide and zinc formaldehyde sulfoxylate; hydrogen peroxide, ammonium persulfate or potassium persulfate with sodium metabisulfite, sodium bisulfite, ferrous sulfate, dimethyl aniline, zinc formaldehyde sulfoxylate or sodium formaldehyde sulfoxylate. Other types of catalysts that are well known in the art can also be used to polymerize the monomers. Catalyst is typically employed in an amount of 0.1 to 2%, preferably 0.25 to 0.75%, based on the weight of the vinyl acetate introduced into the polymerization system. The reducing agent is ordinarily added in aqueous solution in the necessary equlvalent amount.

It is also possible to use redox systems containing a reducing agent which is formaldehyde-free as disclosed in U.S. Pat. No. 4,360,632 which is incorporated by reference.

The emulsifying agents which can be used in the polymerlzation recipe lnclude ionic and nonlonic surfactants, preferably the nonionic types which are well known to those skilled in the polymerization art. Suitable nonionic emulsifying agents include polyoxyethylene condensates.

The concentration range of the total amount of emulsifying agents useful is from 0.5 to 5% based on the aqueous phase of the emulsion regardless of a solids content.

Vinyl acetate/ethylene/N-methylolacrylamide copolymer emulsions of relatively high solids contents can be directly produced having a solids content of 45 to 60%. They can, of course, be easily thinned by the addition of water to lower solids contents of any desired value.

The reaction temperature can be controlled by the rate of free radical source addition and by the rate of heat dissipation. Generally, it is advantageous to maintain a mean temperature of about 50° C. during the polymerization of the monomers and to avoid temperature much in excess of 80° C. While temperatures as low as 0° can be used, economically the lower temperature limit is 30° C.

The reaction time also depends upon other variables such as temperature, the redox system and the desired extent of polymerization. It is generally desirable to continue the reaction to less than 0.5% of the vinyl acetate remains unreacted. In carrying out the polymerization, an amount of a vinyl acetate is initially charged to the polymerization vessel and saturated with ethylene. Most advantageously, at least about 10% of the total vinyl acetate to be polymerized is initially charged, preferably at least about 20%, and the remainder of the vinyl acetate is added incrementally during the course of the polymerization. Charging of all the vinyl acetate initially is also contemplated with no additional incremental supply.

When reference is made to incremental addition, whether of vinyl acetate. N-methylolacrylamide monomer or free radical source, substantially uniform continuous or intermittent additions, both with respect to quantity and time are contemplated. Such additions are also referred to as "delay" additions.

The quantity of ethylene entering the copolymer is influenced by the pressure, the agitation and the viscosity of the polymerization medium. Thus, to increase the ethylene content of the copolymer, high pressures, greater agitation and a low viscosity are employed. The process of formlng the vinyl acetate/ethylene/N-methylolacrylamide copolymer emulsions generally comprises the preparation of an aqueous solution containing at least some of the emulsifying agent and the pH buffering system. This aqueous solution and the initial charge of vinyl acetate are added to the polymerization vessel and ethylene pressure is applied to the desired value. As previously mentioned, the mixture is thoroughly agitated to dissolve ethylene in the vinyl acetate and in the water phase. Conveniently, the charge is brought to polymerization temperature during this agitation period. The polymerization is then initiated by introducing initial amounts of the free radical source. After polymerization has started, the free radical source is incrementally added as required to continue polymerization. For example, either the oxidizing agent or the reducing agent can be added to the initial charge to the polymerization vessel with the other component of the redox system metered into the vessel to maintain control of the polymerization reaction.

The N-methylolacrylamide monomer and the remaining vinyl acetate, if any, are added as separate delays.

The reaction is generally continued until the residual vinyl acetate content is below 0.5%. The completed reaction product is then allowed to cool to about room temperature while sealed from the atmopshere. The pH is then suitably adjusted to a value in the range of 4.5 to 7, preferably 6 to 6.5 to insure maximum stability.

For the preparation of vinyl chloride/ethylene/N-methylolacrylamide copolymers the procedures for vinyl acetate/ethylene/N-methylolacrylamide copolymers can generally be followed substituting vinyl chloride for vinyl acetate while making appropriate changes well known to those skilled in the art.

Another method for producing vinyl acetate/ethylene/N-methylolacrylamide copolymer emulsions comprises first forming an aqueous emulsion of vinyl acetate and emulsifying agent and charging this emulsion to a reactor. The reactor is pressurized with ethylene to an ethylene-equilibrium pressure of about 200 to 500 psig. The resulting reaction mixture is adjusted to a temperature from about 10° to 30° C. Polymerization is initiated by the addition of a free radical source at a rate such that the reaction mixture is brought to a temperature of from 45° to 85° C., preferably 50° to 60° C., within a period of 1 hour or less, preferably 30 minutes. The polymerization is continued until the vinyl acetate content is suitably reduced. Again the N-methylolacrylamide monomer is added to the reaction vessel as a delay charge.

This latter type of polymerization process is described in U.S. Pat. No. 4,332,850 which is incorporated by reference.

The N-methylolacrylamide-containing binder emulsions are used to prepare nonwoven products by a variety of methods known to the art which, in general, involve the impregnation of a loosely assembled mass of fibers with the binder emulsion, followed by moderate heating to dry the mass. In the case of the present invention, this moderate heating comprises heating the impregnated, or "wet", nonwoven substrate for a time and at a temperature sufficient to volatilize a substantial amount of the water, i.e. drying, but insufficient to effect substantial curing of the binder by formlng crosslinked interpolymers. Such drying involves reducing the moisture content of the impregnated nonwoven substrate at the reel roll at end of the production machine to about 8 to about 20%, preferably about 10–12%. The substantially dry binder-containing nonwoven substrate is allowed to cure at a temperature below the drying temperature. For example, the polymer is then maintained at a temperature ranging from ambient to 200° F. to develop substantially full cure. Such curing conditions may range from 5 minutes at 200° F. to more than 4 hours at room temperature of 70° F.

Before the binder is applied it is, of course, mixed with a suitable low temperature acid curing agent for the crosslinking monomer. Suitable low temperature acid curing agents for the present invention comprise an acidic substance having a $pK_a$ ranging from about 1 to 2. Illustrative of such suitable acidic curing agents are organic dicarboxylic acids such as oxalic acid and maleic acid; monocarboxylic acids such as 2,6-dihydroxybenzoic acid and the isomeric 2-, 3-, and 4-pyridinecarboxylic acids; and acid inorganic salts, such as sodium bisulfate. The lower $pk_a$ limit of about 1 is necessary since stronger acids would promote deterioration of the nonwoven fiber and/or the binder polymer. Those acids having a $pK_a$ of greater than about 2 are much less effective in the low temperature curing process, requiring unreasonably long low temperature cure times.

The amount of acidic curing agent is generally about 0.5 to 2% of the total resin.

The starting fiber layer or mass comprising the nonwoven substrate can be formed by any one of the conventional techniques for depositing or arranging fibers in a web or layer. These techniques include wet laying, air laying, carding, garnetting and the like. Individual webs or layers formed by one or more of these techniques can also be laminated to provide a thicker layer for converting purposes. Typically, the fibers extend in a plurality of diverse directions in general alignment with the major plane of the fabric, overlapping, intersecting and supporting one another to form an open, porous structure.

When reference is made to "cellulose" fibers, those fibers containing predominantly $C_6H_{10}O_5$ groupings are meant. Thus, examples of the fibers to be used in the starting layer are the natural cellulose fibers such as wood pulp, cotton and hemp and the synthetic cellulose fibers such as rayon and regenerated cellulose. Often the fibrous starting layer contains at least 50% cellulose fibers, whether they be natural or synthetic, or a combination thereof. Often the fibers in the starting layer may comprise natural fibers such as wool, jute; artificial fibers such as cellulose acetate; synthetic fibers such as polyamides, nylon, polyesters, acrylics, polyolefins, i.e. polyethylene, polyvinyl chloride, polyurethane, and the like, alone or in combination with one another.

The fibrous starting layer is subjected to at least one of the several types of bonding operations to anchor the individual fibers together to form a self-sustaining web. Some of the better known methods of bonding are overall impregnation, or printing the web with intermittent or continuous straight or wavy lines or areas of binder extending generally transversely or diagonally across the web and additionally, if desired, along the web.

The amount of binder, calculated on a dry basis, applied to the fibrous starting web is that amount which is at least sufficient to bind the fibers together to form a self-sustaining web for the desired end-use application and suitably ranges from about 3 to about 100% or more by weight of the starting web, preferably from about 5 to about 50 wt % of the starting web. The impregnated web is then dried and cured following the low temperature cure process of the invention. Thus the substrates are suitably dried by passing them through an air oven or the like for a time and temperature sufficient to volatilize a substantial amount of the water but insufficient to effect substantial crosslinking. Typical drying conditions may be drying at 150° to 200° F. (66° to 93° C.) for 4 to 6 minutes, especially about 5 minutes at 200° F., or about 1.5 minutes at 300° F. followed in both instances by curing at a lower temperature than used for drying.

Nonwoven products prepared in accordance with the low temperature cure process of the invention generally develop approximately 75 to 80% of fully cured (heat-activated) wet tensile strength within about 7 days at room temperature, i.e. 20° C. Under lab conditions fully cured tensiles are obtained by maintaining the impregnated nonwoven web at 300° F. for 5 minutes.

Illustrative of the types of nonwoven products which can be made from wood pulp and, optionally, other fibers utilizing the invention are nonwovens such as paper products, disposable diapers, sanitary napkins, underpads and surgical masks.

In the examples the following commercially available N-methylolacrylamide-containing copolymer emulsions were used:

AIRFLEX ®-105—vinyl acetate/ethylene/N-methylol-acrylamide.

AIRFLEX ®-120—vinyl acetate/ethylene/N-methylol-acrylamide.

AIRFLEX ®-109—vinyl acetate/ethylene/N-methylol-acrylamide.

VINAC ®AX-10—vinyl acetate/N-methylolacrylamide/acrylic acid.

Rhoplex ®HA-B—acrylate/N-methylolacrylamide.

Resyn 2833—vinyl acetate/acrylate/N-methylolacryamide.

AIRFLEX ® and VINAC ® are registered trademarks of Air Products and Chemicals, Inc. for polymer emulsions.

Rhoplex ®is a trademark of Rohm and Haas for polymer emulsions.

Resyn 2833 is marketed by National Starch and Chemical Corp.

The nonwoven substrates used in the following examples were Whatman #4 chromatography paper, Rando rayon and Rando polyester. The copolymer binder emulsion was applied using the Atlas padding technique. The test apparatus was an Instron instrument; 2" jaw span; 1"/min. crosshead speed. The tensiles were measured dry and wet (3 min. immersion in 1% Aerosol OT surfactant/water).

In the following examples, the "fully cured" procedure lnvolved drying and curing the impregnated substrate by heating for five minutes at 300° F.

EXAMPLE 1

AIRFLEX-105 polymer emulsion (A-105) containing 1 wt % oxalic acid was applied to the fiber substrates in the amounts as indicated in Table 1. The impregnated substrates of Runs 1–4 were dried at room temperature and cured at room temperature. In Runs 5 and 6 the drying was performed at 300° F. for 2.5 min. and 45 sec., respectively, conditions which were sufficient to volatilize a substantial amount of the water but insufficient to substantially cure the binder. Runs 7 and 8 demonstrate the fully cured procedure of heating at 300° F. for 5 min.

The Runs demonstrate that the low temperature curing process can provide wet crossmachine direction tensiles that are about 75% of that obtained by the full cure procedure after about 3 to 7 days.

TABLE 1

| RUN | FIBER[A] | % ADD-ON[B], dry | DRYING CONDITIONS | 2 hr PLI | 24 hr PLI | ROOM TEMPERATURE CURE WET C/D TENSILES 72 hr PLI | 1 wk PLI | 2 wk PLI | 4 wk PLI |
|---|---|---|---|---|---|---|---|---|---|
| 1 | Paper | 10 | dried @ RT | | 5.9 | 7.0 | 7.1 | 7.5 | 7.8 |
| 2 | Paper | 20 | " | | 8.9 | 10.3 | 10.6 | 11.2 | 11.7 |
| 3 | Polyester | 30 | " | | 3.3 | 3.0 | 3.4 | 3.6 | 4.9 |
| 4 | Polyester | 50 | " | | 3.6 | 5.0 | 5.6 | 6.6 | 6.7 |
| 5 | Rayon | 50 | 2.5 min @ 300° F. | 3.7 | 4.8 | 4.8 | 4.9 | 5.1 | 5.1 |
| 6 | Polyester | 50 | 45 sec @ 300° F. | 2.4 | 4.6 | 4.9 | 5.7 | 6.3 | 6.5 |
| | | | FULL DRYING AND CURING | DRY PLI | WET PLI | | | | |
| 7 | Polyester | 30 | 5 min @ 300° F. | 5.1 | 4.9 | | | | |
| 8 | Polyester | 50 | " | 5.8 | 4.6 | | | | |

[A]Paper = Whatman #4 Chromatography Paper
Rayon = Rando Rayon
Polyester = Rando Polyester
[B]Airflex 105 + 1% oxalic acid In the following Examples 2 and 3 the indicated N-methylolacrylamide-containing emulsion was applied to Whatman #4 paper at a level of 10% dry add-on. Drying was performed in an air-circulating oven at the drying conditions indicated in the Tables. For the full drying and curing procedure of 5 min. at 300° F., less than ½% moisture remained while use of the low temperature curing procedure of 1.5 min. at 300° F. resulted in approximately 10% moisture retention followed by room temperature curing. Room temperature curing consisted of 73° F. and 53% relative humidity.

EXAMPLE 2

In this example AIRFLEX-105 polymer emulsion (A-105) padded on paper substrate was cured with various acid catalysts under various drying and room temperature curing conditions as set forth in Table 2.

Table 3 shows the data obtained using maleic acid, sodium bisulfate and ammonium chloride in place of oxalic acid with AIRFLEX-105 emulsion under different drying conditions followed by room temperature curing.

Table 4 shows the wet tensiles of AIRFLEX-105, 109 and 120 emulsion polymers (A-105, A-109 and A-120) using oxalic acid, maleic acid and sodium bisulfate catalysts.

TABLE 2

| A105 + 1% of: | 1st pKa | WET TENSILE (PLI)* FULLY (5 min/300° F.) Initial | FULLY 30 Days | L.T.C. (1½ min/300° F.) Initial | L.T.C. 7 Days | L.T.C. 30 Days | % L.T.C. OF FULLY (INITIAL) Initial | 7 Days | 30 Days | % WET TENSILE/DRY TENSILE FULLY Initial | FULLY 30 Days | L.T.C. Initial | L.T.C. 7 Days | L.T.C. 30 Days |
|---|---|---|---|---|---|---|---|---|---|---|---|---|---|---|
| Oxalic acid | 1.23 | 8.2 | 8.1 | 3.3 | 6.5 | 7.1 | 40 | 79 | 87 | 55 | 51 | 25 | 46 | 46 |
| Maleic acid[A] | 1.83 | 8.0 | 8.1 | 2.5 | 6.3 | 6.8 | 31 | 79 | 85 | 53 | 49 | 19 | 42 | 43 |
| Sodium Bisulfate | 1.92 | 7.6 | 7.6 | 1.6 | 5.8 | 6.8 | 21 | 76 | 90 | 48 | 48 | 11 | 38 | 41 |
| pTSA[B] | 0.7 | 7.6 | 8.0 | 1.9 | 4.7 | 6.0 | 25 | 62 | 79 | 49 | 49 | 14 | 31 | 40 |
| Tartaric Acid | 3.00 | 7.0 | 7.1 | 0.8 | 3.3 | 5.0 | 11 | 47 | 71 | 48 | 43 | 7 | 23 | 33 |
| Fumaric acid[B] | 3.03 | 7.5 | 7.4 | 0.8 | 2.8 | 4.2 | 11 | 38 | 56 | 44 | 45 | 5 | 21 | 27 |
| Citric acid[B] | 3.08 | 6.8 | 6.4 | 0.4 | 2.6 | 4.4 | 6 | 38 | 65 | 45 | 44 | — | — | — |
| Phosphoric acid[B,C] | 2.12 | 7.5 | 7.4 | 0.9 | 2.3 | 3.6 | 12 | 31 | 48 | 44 | 45 | 6 | 17 | 23 |
| Itaconic acid[B] | 3.85 | 7.3 | 7.1 | 0.7 | 1.6 | 2.9 | 10 | 22 | 40 | 45 | 44 | 5 | 12 | 19 |
| Ammonium chloride[B] | 9.25 | 6.3 | 7.2 | 0.5 | 1.4 | 2.8 | 8 | 22 | 44 | 43 | 49 | 4 | 11 | 21 |
| Acrylic acid[B] | 4.25 | 5.7 | 5.4 | 0.5 | 0.8 | 1.1 | 9 | 14 | 19 | 40 | 40 | 4 | 7 | 9 |

TABLE 2-continued

| A105 + 1% of: | 1st pKa | WET TENSILE (PLI)* FULLY (5 min/300° F.) Initial | 30 Days | L.T.C. (1½ min/300° F.) Initial | 7 Days | 30 Days | % L.T.C. OF FULLY (INITIAL) Initial | 7 Days | 30 Days | % WET TENSILE/DRY TENSILE FULLY Initial | 30 Days | L.T.C. Initial | 7 Days | 30 Days |
|---|---|---|---|---|---|---|---|---|---|---|---|---|---|---|
| As is, No Catalyst[B] | — | 3.2 | 3.2 | 0.4 | 0.7 | 0.7 | 13 | 22 | 22 | 22 | 21 | 3 | 5 | 5 |

*Initial tensiles were measured within 2–4 hr.
10% add-on, dry
[A]Maleic anhydride hydrolyzed in water overnight.
[B]Single evaluation only.
[C]To give a 2.5 pH.

TABLE 3

| | WET TENSILES (PLI)* 5 min/300° F. INITIAL | 5 min/300° F. 30 DAYS | 5 min/200° F. INITIAL | 1½ min/300° F. INITIAL | 1½ min/300° F. 30 DAYS |
|---|---|---|---|---|---|
| A105 + 1% Maleic Acid | 8.0 | 8.1 | 3.2 | 2.5 | 6.8 |
| A105 + 1% $NaHSO_4$ | 7.6 | 7.6 | 2.2 | 1.6 | 6.8 |
| A105 + 1% $NH_4Cl$ | 6.3 | 7.2 | 0.6 | 0.5 | 2.8 |

*10% dry add-on that maleic acid was effective with AIRFLEX-109 and AIRFLEX-120 emulsions.

Interestingly, the normally recommended catalyst for a full cure, sodium bisulfate, also gave an effective low temperature cure. Values in Table 2 for sodium bisulfate with AIRFLEX-105 emulsion are less than for oxalic acid in: full cure (7.6 versus 8.1 pli), low temperature cure-initial (1.6 versus 3.3 pli), low temperature cure-7 days (5.8 versus 6.5 pli) and low temperature cure-30 days (6.8 versus 7.1 pli).

It can also be seen from the data in Table 2 that cure strength development appears to correlate with the first association constant ($pK_a$) value of the acid catalysts,

TABLE 4

| System | 1st pKa | WET TENSILE (PLI)* FULLY (5 min/300° F.) Initial | 30 Days | L.T.C. (1½ min/300° F.) Initial | 7 Days | 30 Days | % L.T.C. OF FULLY (INITIAL) Initial | 7 Days | 30 Days | % WET TENSILE/DRY TENSILE FULLY Initial | 30 Days | L.T.C. Initial | 7 Days | 30 Days |
|---|---|---|---|---|---|---|---|---|---|---|---|---|---|---|
| A105 + 1% Oxalic Acid | 1.23 | 8.2 | 8.1 | 3.3 | 6.5 | 7.1 | 40 | 79 | 87 | 55 | 51 | 25 | 46 | 46 |
| +1% Maleic Acid[A] | 1.83 | 8.0 | 8.1 | 2.5 | 6.3 | 6.8 | 31 | 79 | 85 | 53 | 49 | 19 | 42 | 43 |
| +1% Sodium Bisulfate | 1.92 | 7.6 | 7.6 | 1.6 | 5.8 | 6.8 | 21 | 76 | 90 | 48 | 48 | 11 | 38 | 41 |
| A106 + 1% Oxalic Acid | 1.23 | 7.8 | 7.6 | 2.9 | 6.4 | 6.6 | 37 | 82 | 85 | 56 | 52 | 23 | 47 | 46 |
| +1% Maleic Acid[A] | 1.83 | 7.9 | 7.6 | 2.3 | 6.0 | 6.5 | 29 | 76 | 82 | 55 | 50 | 18 | 43 | 43 |
| +1% Sodium Bisulfate | 1.92 | 7.4 | 7.2 | 1.2 | 5.1 | 6.0 | 16 | 69 | 81 | 49 | 49 | 9 | 38 | 40 |
| A120 + 1% Oxalic Acid | 1.23 | 7.1 | 6.8 | 2.5 | 5.6 | 6.4 | 35 | 79 | 90 | 52 | 50 | 21 | 41 | 49 |
| +1% Maleic Acid[A] | 1.83 | 7.6 | 7.3 | 2.2 | 5.8 | 6.4 | 29 | 76 | 84 | 51 | 51 | 15 | 41 | 41 |
| +1% Sodium Bisufate | 1.92 | 5.9 | 5.7 | 2.0 | 4.4 | 4.4 | 34 | 75 | 75 | 46 | 47 | 17 | 38 | 38 |

*Initial tensiles were measured within 2–4 hours.
10% dry add-on
[A]Used maleic anhydride hydrolyzed in water overnight.

The data presented in Tables 2–4 show that oxalic acid is a very efficient catalyst with N-methylolacrylamide containing copolymer emulsions for not only low temperature curing but also full curing wet tensile development.

As can be seen in Table 2, of all the acids investigated with AIRFLEX-105 emulsion, maleic acid was fairly similar to oxalic acid in low temperature curing and fully cured wet strengths. Oxalic acid and maleic acid both showed an 8.1 pli at full cure-30 days and for low temperature curing-30 days, oxalic acid showed 7.1 pli and maleic acid showed 6.8 pli. Maleic acid was slightly less effective in low temperature cure-initial development, a 2.5 pli versus a 3.3 pli for oxalic acid. Thus maleic acid was found to be a worthy catalyst substitute for the very toxic oxalic acid. Its overall wet strength was similar to oxalic acid. In addition, Table 4 shows the lower the $pK_a$ the greater the wet strength. Oxalic acid with a $pK_a$ of 1.25 compared to itaconic acid with a relatively high $pK_a$ of 3.85 showed fully cured and low temperature cured-30 days wet tensiles of 8.1 and 7.1 pli versus 7.1 and 2.9 pli, respectively.

Table 3 shows that ammonium chloride which is another acid catalyst recommended for heat-activated cure gave a fully cured wet tensile slightly less than sodium bisulfate. However, its low temperature cure development was very poor.

The data in Table 4 shows the trend for oxalic acid and maleic acid as more effective catalysts than sodium bisulfate with AIRFLEX-105, AIRFLEX-109 and AIRFLEX-120 emulsions. Surprisingly, the effectiveness spread of the organic acids versus sodium bisulfate is greater with AIRFLEX-120 emulsion than with AIRFLEX-105 and AIRFLEX-109 emulsions.

TABLE 5

WET TENSILES OF VARIOUS NMA EMULSIONS WITH 1% OXALIC ACID

| | WET TENSILE (PLI)* | | | | % L.T.C. OF FULLY (INITIAL) | | | % WET TENSILE/DRY TENSILE | | | |
|---|---|---|---|---|---|---|---|---|---|---|---|
| | FULLY (5 min/300° F.) | L.T.C. (1½ min/300° F.) | | | | | | FULLY | L.T.C. | | |
| 1% OXALIC ACID | Initial | Initial | 7 Days | 30 Days | Initial | 7 Days | 30 Days | Initial | Initial | 7 Days | 30 Days |
| A105 | 8.2 | 3.3 | 6.5 | 7.1 | 40 | 79 | 87 | 55 | 25 | 46 | 46 |
| A106 | 7.8 | 2.9 | 6.4 | 6.6 | 37 | 82 | 85 | 56 | 23 | 47 | 46 |
| AX-10 | 7.4 | 0.6 | 1.5 | 2.5 | 8 | 20 | 34 | 41 | 4 | 8 | 14 |
| A120 | 7.1 | 2.5 | 5.6 | 6.4 | 35 | 79 | 90 | 52 | 21 | 41 | 49 |
| EVCl—NMA | 6.6 | 1.0 | 4.2 | 5.3 | 15 | 64 | 80 | 56 | 10 | 38 | 42 |
| HA-8 | 6.4 | 1.2 | 4.2 | 4.4 | 19 | 66 | 69 | 52 | 10 | 36 | 37 |
| 2833 | 4.6 | 0.5 | 1.0 | 1.2 | 11 | 22 | 26 | 42 | 5 | 8 | 11 |
| As is, no catalyst: | | | | | | | | | | | |
| A105 | 3.2 | 0.4 | 0.7 | 0.7 | 13 | 22 | 22 | 22 | 3 | 5 | 5 |
| A106 | 2.0 | 0.4 | 0.6 | 0.7 | 20 | 30 | 35 | 15 | 3 | 5 | 5 |
| AX-10 | 4.0 | 0.3 | 0.4 | 0.6 | 8 | 10 | 15 | 20 | 2 | 2 | 4 |
| A120 | 2.8 | 0.4 | 0.9 | 0.7 | 14 | 32 | 25 | 20 | 3 | 7 | 5 |

*Initial tensiles were measured within 2–4 hours.
10% dry add-on

The data in Table 5 shows that AIRFLEX-105, AIRFLEX-109 and AIRFLEX-120 emulsions with oxalic acid curing agent were superior to the Rohm and Haas HA-8 and National Starch 2833 N-methylolacrylamide-containing copolymer emulsions in both fully cured and low temperature cured wet tensiles. VINAC AX-10 emulsion with oxalic acid gave a relatively high fully cured wet tensile but was very inefficient in low temperature cure-30 days wet tensile, 7.4 pli and 2.5 pli respectively.

The vinyl chloride-ethylene-N-methylolacrylamide (EVCl-NMA) and oxalic acid system though intermediate in fully cured (6.6 pli) and low temperature cure (5.3 pli) wet strength development was still slightly better than the HA-8 emulsion and much better than the 2833 emulsion.

Table 5 also shows the fully cured and low temperature cured wet tensiles of some of the emulsions without any catalyst added. Fully cured wet tensiles were poor ranging from 2.0 to 4.0 pli and low temperature cured-30 days were extremely poor ranging from 0.6 to 1.1 pli.

EXAMPLE 3

Table 6 presents the wet tensile strengths of various vinyl acetate/ethylene/N-methylolacrylamide copolymer emulsions with and without 1% sodium bisulfate. National Starch's VAc/E/NMA Emulsion Duro-Set E-623 and E-669 emulsions with the sodium bisulfate acid catalyst displayed relatively low fully cured and very poor low temperature cured wet tensiles.

TABLE 6

WET TENSILES OF VARIOUS VAE/NMA COPOLYMER EMULSIONS WITH 1% SODIUM BISULFATE

| | WET TENSILE (PLI)* | | | | | % L.T.C. OF FULLY (INITIAL) | | | % WET TENSILE/DRY TENSILE | | | | |
|---|---|---|---|---|---|---|---|---|---|---|---|---|---|
| | FULLY (5 min/300° F.) | | L.T.C. (1½ min/300° F.) | | | | | | FULLY | | L.T.C. | | |
| | Initial | 30 Days | Initial | 7 Days | 30 Days | Initial | 7 Days | 30 Days | Initial | 30 Days | Initial | 7 Days | 30 Days |
| 1% Sodium Bisulfate +: | | | | | | | | | | | | | |
| A105 | 7.6 | 7.6 | 1.6 | 5.8 | 6.8 | 21 | 76 | 90 | 48 | 48 | 11 | 38 | 41 |
| A106 | 7.4 | 7.2 | 1.2 | 5.1 | 6.0 | 16 | 69 | 81 | 49 | 49 | 9 | 38 | 40 |
| A120 | 5.9 | 5.7 | 2.0 | 4.4 | 4.4 | 34 | 75 | 77 | 46 | 47 | 17 | 38 | 38 |
| E-623 | 6.5 | 6.1 | 1.0 | 1.4 | 1.5 | 15 | 22 | 23 | 45 | 45 | 8 | 11 | 13 |
| E-669 | 4.8 | 4.4 | 0.5 | 0.8 | 1.2 | 10 | 17 | 25 | 48 | 44 | 6 | 9 | 15 |
| "AS-IS", No Catalyst: | | | | | | | | | | | | | |
| A105 | 3.2 | 3.2 | 0.4 | 0.7 | 0.7 | 13 | 22 | 22 | 22 | 22 | 3 | 5 | 5 |
| A106 | 2.0 | — | 0.4 | 0.6 | 0.7 | 20 | 30 | 35 | 15 | — | 3 | 5 | 5 |
| A120 | 2.8 | — | 0.4 | 0.9 | 0.7 | 13 | 32 | 25 | 20 | — | 3 | 7 | 5 |
| E-623 | 4.1 | 3.7 | 0.6 | 0.8 | 1.0 | 15 | 20 | 24 | 29 | 29 | 5 | 6 | 9 |
| E-669 | 3.8 | 3.7 | 0.5 | 0.7 | 0.9 | 13 | 18 | 24 | 37 | 39 | 6 | 8 | 11 |

*Initial tensiles were measured within 2–4 hours.
10% dry add-on

STATEMENT OF INDUSTRIAL APPLICATION

The invention provides a method for acid catalyzed-low temperature curing of N-methylolacrylamide-containing vinyl acetate/ethylene and vinyl chloride/ethylene copolymer binder emulsions in the production of nonwoven products.

We claim:

1. In a method for preparlng a nonwoven product bonded with an N-methylolacrylamide-containing copolymer resin which comprises applying the aqueous resin emulsion containing an acidic curing agent to a nonwoven web of fibers and drying and curing the nonwoven web at elevated temperatures to drive off water and to effect cross-linking of the N-methylolacrylamide-containing resin, the improvement which comprises (a) adding to a vinyl acetate/ethylene/N-methylolacrylamide or a vinyl chloride/ethylene/N-methylolacrylamide copolymer emulsion a curingly effective amount of an acidic curing agent having a $pK_a$ ranging from about 1 to 2 and applying to a nonwoven web, (b) heating the treated nonwoven web for a time and at a temperature sufficient to volatilize a substantial amount of the water but insufficient to effect substantial crosslinking of the resin and (c) maintaining the copolymer on the dried nonwoven web at a temperature which is less than the temperature of step (b) and for a time sufficient to develop essentially full cure.

2. The method of claim 1 in which the N-methylolacrylamide-containing copolymer is a vinyl acetate/ethylene/N-methylolacrylamide copolymer.

3. The method of claim 1 in which the acidic curing agent is oxalic acid, maleic acid, or sodium bisulfate.

4. The method of claim 2 in which the acidic curing agent is oxalic acid, maleic acid, or sodium bisulfate.

5. The method of claim 1 in which the curing agent is maleic acid.

6. The method of claim 2 in which the curing agent is maleic acid.

7. The method of claim 1 in which the curing temperature of step (c) ranges from ambient to 200° F.

8. The method of claim 2 in which the curing temperature of step (c) ranges from ambient to 200° F.

9. The method of claim 1 in which the copolymer emulsion treated nonwoven web is dried in step (b) to a moisture content of about 8 to 20%.

10. The method of claim 2 in which the copolymer emulsion treated nonwoven web is dried in step (b) to a moisture content of about 8 to 20%.

11. In a method for preparing a nonwoven product bonded with an N-methylolacrylamide-containing copolymer resin selected from the group consisting of a vinyl acetate/ethylene/N-methylolacrylamide copolymer and a vinyl chloride/ethylene/N-methylolacrylamide copolymer which comprises applying the aqueous resin emulsion containing an acidic curing agent to a nonwoven web of fibers and drying and curing the nonwoven web at elevated temperatures to drive off water and to effect cross-linking of the N-methylolacrylamide-containing resin, the improvement which comprises (a) adding to the copolymer emulsion a curingly effective amount of an acidic curing agent having a $pK_a$ ranging from about 1 to 2 and applying to a nonwoven web, (b) heating the treated nonwoven web for a time and at a temperature sufficient to dry the web to a moisture content of about 8 to 20% but insufficient to effect substantial crosslinking of the resin, and (c) maintaining the copolymer on the dried nonwoven web at a temperature ranging from ambient to 200° F. which temperature is less than the temperature of step (b) and for a time sufficient to develop essentially full cure.

12. The method of claim 11 in which the N-methylolacrylamide-containing copolymer is a vinyl acetate/ethylene/N-methylolacrylamide copolymer.

13. The method of claim 11 in which the acidic curing agent is oxalic acid, maleic acid, or sodium bisulfate.

14. The method of claim 12 in which the acidic curing agent is oxalic acid, maleic acid, or sodium bisulfate.

15. The method of claim 11 in which the curing agent is maleic acid.

16. The method of claim 12 in which the curing agent is maleic acid.

17. The method of claim 11 in which step (b) is performed at 150° to 200° F.

18. The method of claim 12 in which step (b) is performed at 150° to 200° F.

19. The method of claim 11 in which step (b) is performed at about 300+ F.

20. The method of claim 12 in which step (b) is performed at about 300° F.

* * * * *